US009994359B2

(12) United States Patent
Hansen

(10) Patent No.: US 9,994,359 B2
(45) Date of Patent: Jun. 12, 2018

(54) PALLET SHELF SYSTEM AND METHOD OF STORING GOODS ON A PALLET SHELF SYSTEM

(71) Applicant: SPACE INVADER IVS, Copenhagen S (DK)

(72) Inventor: Jesper Rølund Hansen, Copenhagen S (DK)

(73) Assignee: SpaceInvader ApS, Copenhagen K (DK)

( * ) Notice: Subject to any disclaimer, the term of this patent is extended or adjusted under 35 U.S.C. 154(b) by 0 days. days.

(21) Appl. No.: 15/028,743

(22) PCT Filed: Oct. 10, 2014

(86) PCT No.: PCT/DK2014/050323

§ 371 (c)(1),
(2) Date: Apr. 12, 2016

(87) PCT Pub. No.: WO2015/055206

PCT Pub. Date: Apr. 23, 2015

(65) Prior Publication Data

US 2016/0264291 A1 Sep. 15, 2016

(30) Foreign Application Priority Data

Oct. 14, 2013 (DK) ..... 2013 00585

(51) Int. Cl.
*B65D 19/40* (2006.01)
*B65D 19/38* (2006.01)
(Continued)

(52) U.S. Cl.
CPC ..... *B65D 19/385* (2013.01); *A47B 47/0083* (2013.01); *B65D 19/40* (2013.01);
(Continued)

(58) Field of Classification Search
CPC .. B65D 19/384; B65D 19/40; B65D 21/0209; B65D 21/0215
See application file for complete search history.

(56) References Cited

U.S. PATENT DOCUMENTS 2,495,711 A 1/1950 Fletcher
2,686,645 A * 8/1954 Whitehurst ..... B65D 19/385 108/53.5
(Continued)

FOREIGN PATENT DOCUMENTS

CA 535389 A 1/1957
DE 7109795 U 7/1971
(Continued)

OTHER PUBLICATIONS

International Search Report for Application No. PCT/DK2014/050323, dated Aug. 1, 2015, 2 pages.
(Continued)

*Primary Examiner* — Daniel J Rohrhoff
(74) *Attorney, Agent, or Firm* — Ziegler IP Law Group, LLC

(57) ABSTRACT

A pallet shelf system for storing goods on standardized pallets in particular in the cargo hold of a truck or a lorry, the system being easy to assemble and disassemble at cargo is loaded and unloaded in the cargo hold; and a method of storing goods.

8 Claims, 6 Drawing Sheets

(51) Int. Cl.
*A47B 47/00* (2006.01)
*B65D 19/00* (2006.01)

(52) U.S. Cl.
CPC ..... *B65D 19/0095* (2013.01); *B65D 2519/00029* (2013.01); *B65D 2519/00064* (2013.01); *B65D 2519/0097* (2013.01); *B65D 2519/00099* (2013.01); *B65D 2519/00233* (2013.01); *B65D 2519/00273* (2013.01); *B65D 2519/00293* (2013.01); *B65D 2519/00298* (2013.01); *B65D 2519/00323* (2013.01); *B65D 2519/00333* (2013.01); *B65D 2519/00373* (2013.01); *B65D 2519/00676* (2013.01)

(56) References Cited

U.S. PATENT DOCUMENTS 2,924,339 A * 2/1960 Skubic ..... B65D 19/385 108/53.5
2,936,477 A * 5/1960 Feller ..... B60S 1/0405 15/250.19
2,936,984 A * 5/1960 Skubic ..... B65D 19/385 108/53.5
3,249,072 A * 5/1966 Skubic ..... B65D 19/385 108/53.5
3,400,671 A * 9/1968 Erismann ..... B65D 19/0095 108/53.5
3,982,638 A * 9/1976 Lamson ..... A47B 87/0215 108/55.1
4,673,092 A 6/1987 Lamson et al.
4,773,547 A * 9/1988 Bell ..... A47B 87/0215 108/53.1
4,955,490 A 9/1990 Schafer
5,233,931 A * 8/1993 McCorkle, Jr. ..... B65D 19/12 108/55.1
6,809,329 B1 * 10/2004 Evans ..... B65D 21/0215 250/506.1
2007/0095775 A1 * 5/2007 Beck ..... B65D 19/12 211/194
2011/0303129 A1 * 12/2011 Harris ..... B65D 19/08 108/53.1
2016/0264292 A1 * 9/2016 Schoening ..... G06Q 10/0833

FOREIGN PATENT DOCUMENTS

FR 2581972 A2 11/1986
GB 1457358 A 12/1976
GB 1570611 A 7/1980
GB 2231552 A 11/1990
GB 2494615 A 3/2013

OTHER PUBLICATIONS

Danish Patent and Trademark Office, First Technical Examination, Application No. PA201300585, dated May 26, 2014, 3 pages.
Danish Patent and Trademark Office, Search Report, Application No. PA201300585, dated May 26, 2014, 4 pages.

* cited by examiner

1A

1B

1C

PALLET SHELF SYSTEM AND METHOD OF STORING GOODS ON A PALLET SHELF SYSTEM

FIELD

The present application relates to a pallet shelf system for storing goods in particular for storing goods on standardized pallets such as e.g. euro pallets and a method of storing goods.

BACKGROUND

In logistics the use of standardized pallets enables the transporter to efficiently make use of the cargo space either during transport or during storage.

A pallet is a flat transport structure that supports goods in a stable fashion while being lifted by a forklift, pallet jack, front loader, work saver or other jacking device. A pallet is the structural foundation of a unit load which allows handling and storage efficiencies. Goods or shipping containers are often placed on a pallet secured with strapping, stretch wrap or shrink wrap and shipped. While most pallets are wooden, pallets also are made of plastic, metal, and paper. Numerous pallet standards are known, foremost of these ISO pallets, North American Pallets, Euro Pallets and Australian Standard Pallets.

Pallet shelf systems are useful as a means for shelving goods stored on pallets whenever it is desired to have several layers of pallets stored on top of each other.

In the art, see e.g. U.S. Pat. No. 4,955,490, pallet shelf systems are known which permit the safe storage of goods on pallets on the pallet shelves while yet permitting the shelves to be adjusted to variable heights dependent on the goods stored on the pallet.

Due to the weight of the pallets and goods, pallet shelf systems as known in the art lack flexibility (although adjustable with respect to shelf distance), and ease of assembly. This in particular represents a problem in many situations wherein it is desired to have temporary pallet shelf systems, e.g. in the cargo hold of a truck or lorry; which does not see regular service as a pallet transporter.

In GB 2231552 A there is described a method for creating a pallet shelf system, the use of a pallet shelf system and a pallet shelf system with one or more shelves comprising one or more pallets, four or more upright posts; and two or more pallet shelf base units, each base unit adapted for supporting a part of the weight of a pallet including goods. While these elements address some of the above mentioned technical problems, the rigid construction contemplated in GB 2231552 A is unfortunate when ease of assembly and disassembly is contemplated.

It is an object of the present invention to overcome the limitations of the prior art by supplying a pallet shelf system which is easy to assemble and disassemble, in particular for use in the cargo hold of a truck or lorry, and a method of storing pallets in a cargo hold using a pallet shelf system according to the present invention.

BRIEF DESCRIPTION OF THE DRAWINGS

FIG. 1*a* shows the pallet viewed along the long axis or along the FIG. 1*b* shows the pallet viewed along the short axis, FIG. 1*c* shows the load-bearing surface of the standard (euro) pallet.

DETAILED DESCRIPTION

Figure 1:
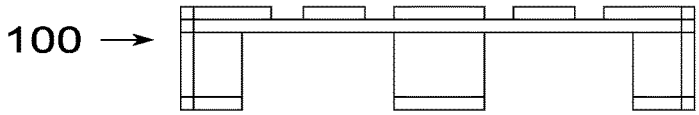
FIG. 1 shows a standard (euro) pallet, which presents two openings which can be accessed by a fork lifter.
Figure 1:
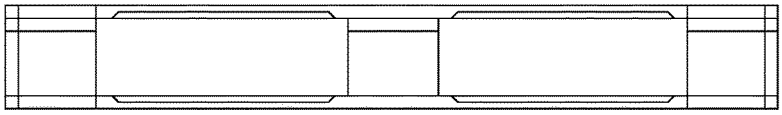
Figure 1:
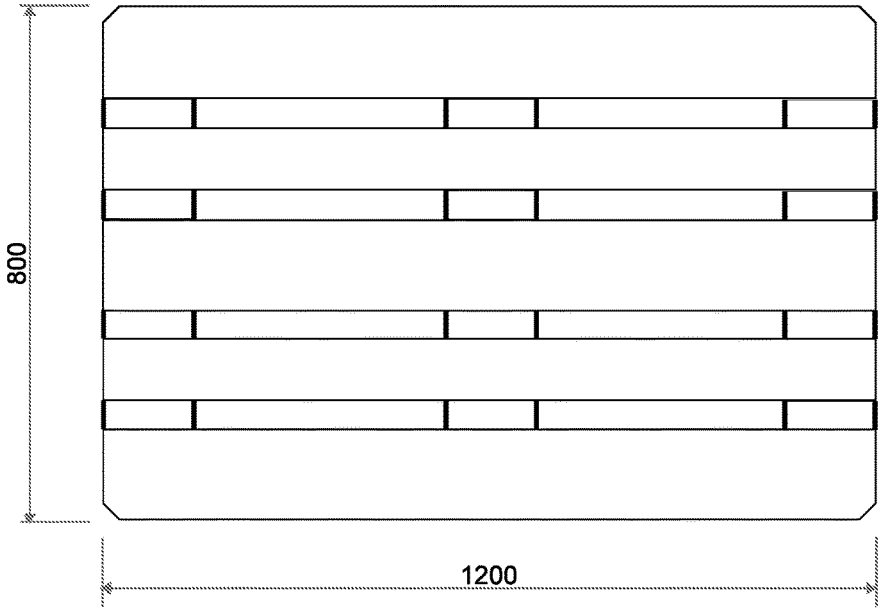

Pallets for transporting goods are commonly known. They confer to a narrow number of industry standards, e.g. euro pallets, ISO pallets or various Australian or North American pallet standards. Such pallets are generally of a size making it possible for fork lifters of ordinary size to handle pallet and goods stored there upon, one at a time. FIG. 1 show an exemplary drawing of a euro pallet (100) made from wood which is used throughout the present document to illustrate the functioning of the present invention. As the present invention is adaptable to any of these pallet standards, wherein the pallet can be handled using a fork lifter, this document will refer to such pallet as "a standard size pallet". This term is taken as including but not limiting to euro pallets and ISO pallets, preferably euro pallets.

Figure 2:
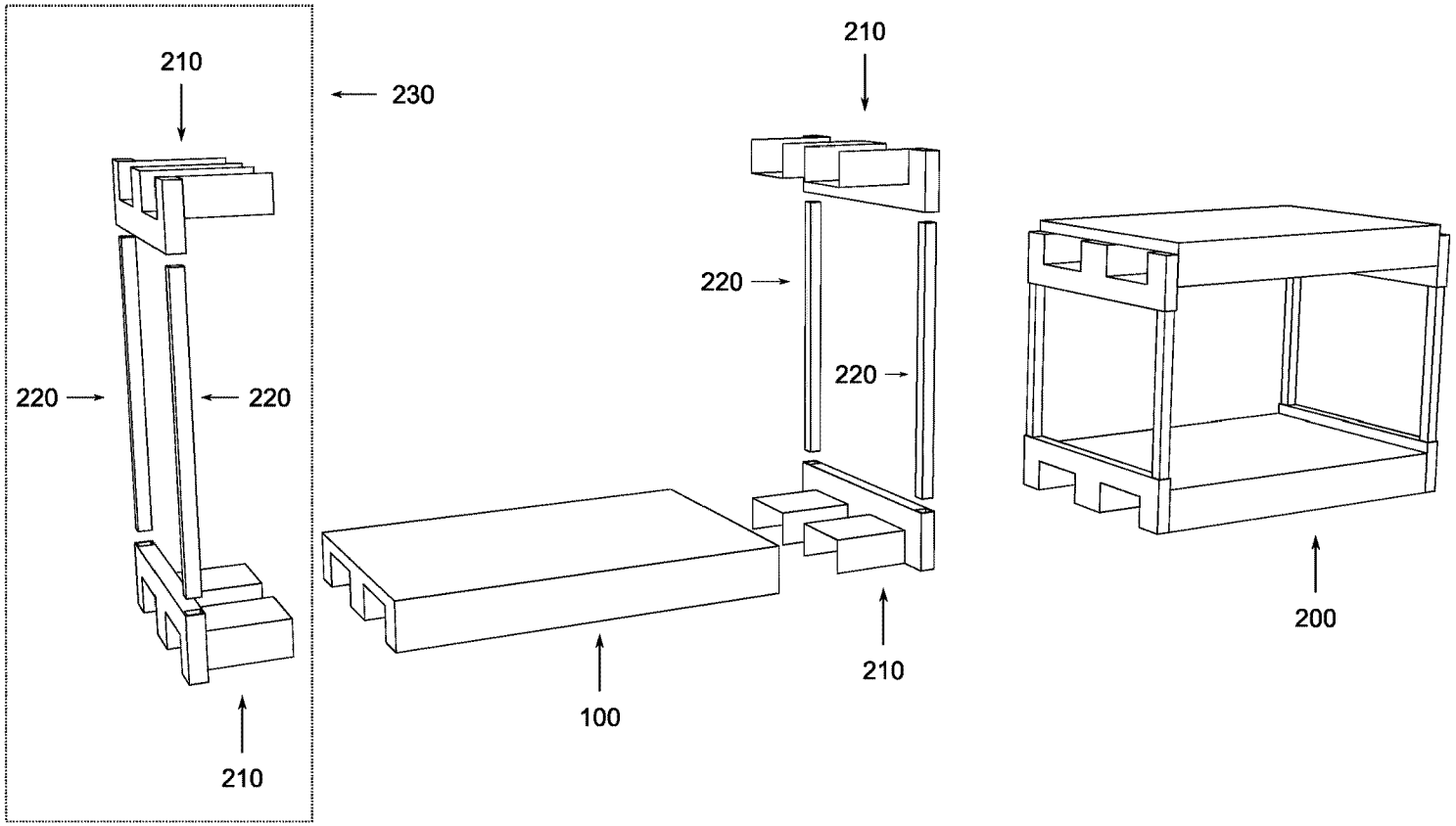
FIG. 2 shows a first embodiment of the present invention wherein the structural components of the pallet shelf system is illustrated.

In FIG. 2 the concept underlying the present invention is illustrated. A set of four pallet shelf system base units (210) are assembled pair wise using at least two upright posts (220) with each pair base units (210) whereupon each assembly is stabilized with two pallets (100) serving as shelves to form a pallet shelf system (200) having two shelves. In use the pallets (100) rest on the base units (210) either partially or completely. The base units (210) are constructed to carry the weight of pallet (100) and any goods stored there upon.

It is an advantage of the present invention, that the pallet shelf system (200) can be assembled without removing the goods from the pallets during assembly. Thereby pallet shelves can be assembled in an easy manner in a temporary storage facility, e.g. in the cargo hold of a truck or a lorry, during the loading of the cargo into the hold; and reversely shelves can be disassembled as the cargo hold is emptied. Depending on goods sizes, the distance between shelves can be varied by varying the length of the upright posts (220).

Figure 3:
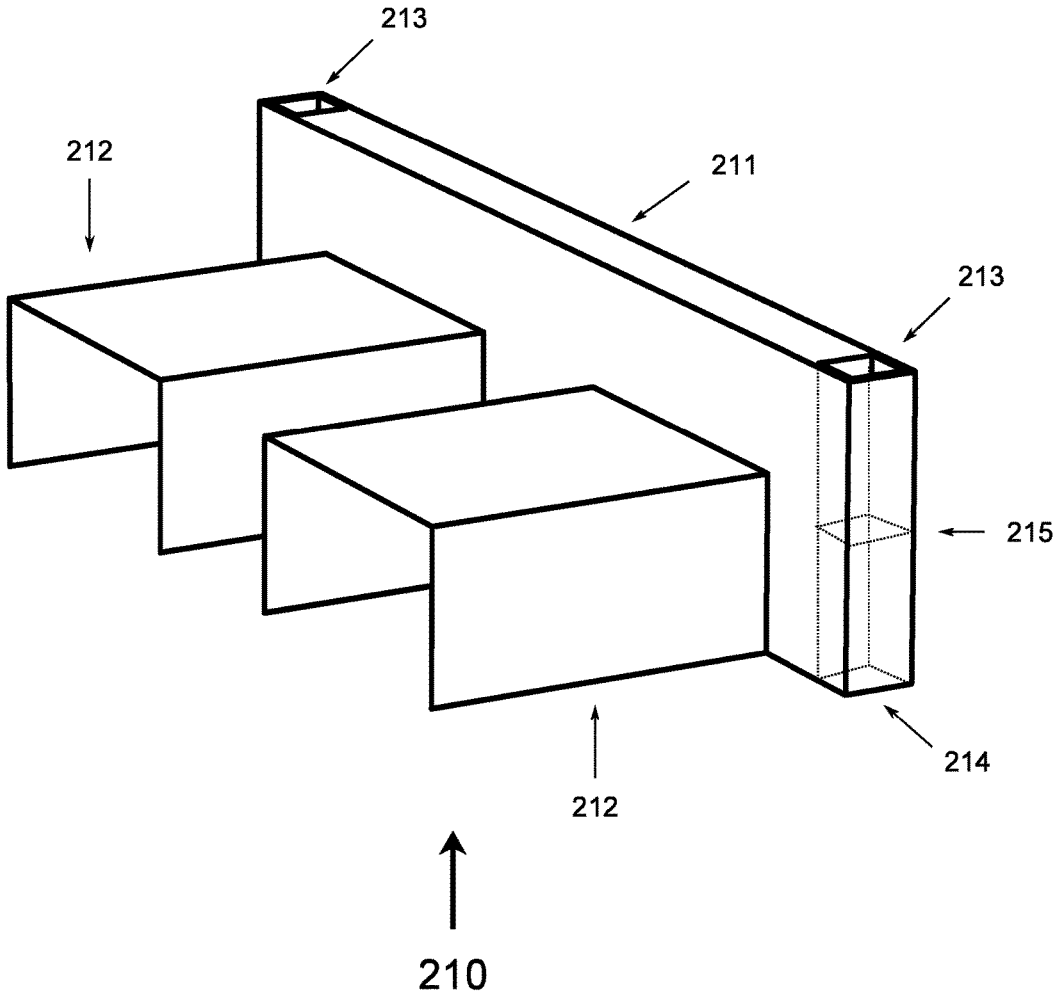
FIG. 3 shows a detailed drawing of a base unit of the pallet shelf system.

FIG. 3 shows the base unit (210) of the present invention in more detail. It comprises a base plate (211) and a number of protrusions (212) mounted on a side of said base plate (211) at essentially rights angles to said base plate (211). The protrusions (212) are matched in number and size to fit into each side opening of the pallet (100) for which the pallet shelf system (200) of the present invention is adapted to. As can be seen from FIGS. 1*a* and 1*b*, a euro pallet has on each side two openings which are accessible to a fork lifter. In normal operation, the fork lifter accesses the pallet from the narrower end (FIG. 1*a*) but the present invention is adaptable to both configurations. Depending on the loads to be carried by the protrusions (212) exerted on said protrusions by pallet and cargo on said pallet, the construction of said protrusions (212) may vary. Such variations are routine to the skilled person working with static constructions and hence, the present invention is not limited by the construction of the protrusions shown in the figure.

The base plate (211) comprises a first set of at least two mounting holes (213) mounted on a side of said base plate (211) for receiving the above mentioned at least two upright posts (220) with said posts protruding in the same direction after mounting. Advantageously the mounting holes (213) are spaced such a distance apart as to impart the best possible structural stability to the pallet shelf system (200). In some systems it will be advantageous to have more than two mounting holes (213) on the same side of said base plate (211) to facilitate the mounting of further upright posts (220), in particular when the cargo stored on the upper shelves are very heavy. It is further of advantage that said base plate (211) comprises a second set of mounting holes (214) located on a side of said base plate (211) opposite said first set of mounting holes (213) as will be describe later. In the embodiment illustrated in the present drawing, the mounting holes is made from a square pipe with a plate (215) in the middle to create the two opposite set of mounting holes (213, 214).

Figure 4:
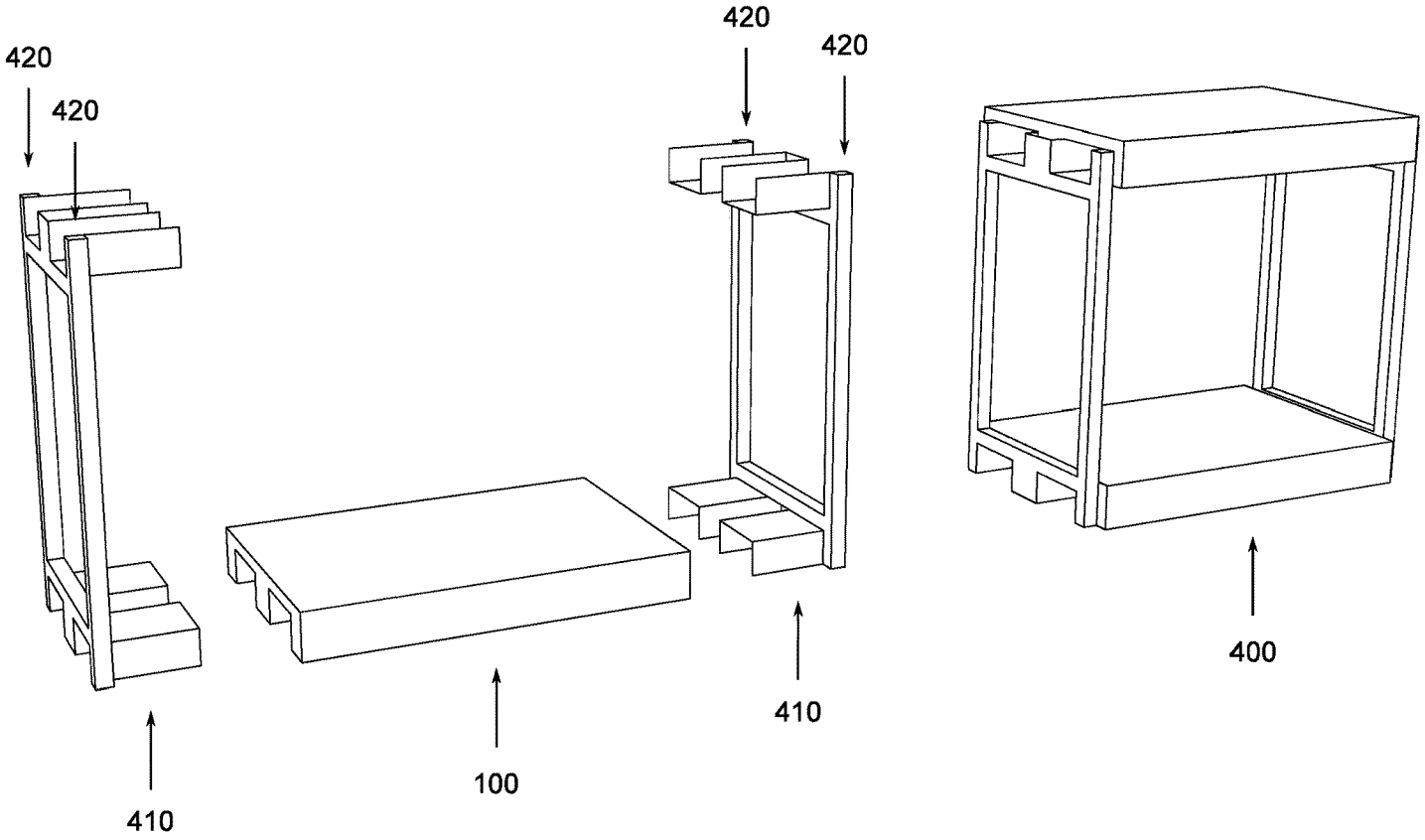
FIG. 4 shows a further embodiment of the pallet shelf system.

In FIG. 4 a further embodiment of the present invention is illustrated. In this embodiment the base unit (210) and the aforementioned upright posts (220) have been permanently assembled, e.g. by welding, to form a larger assembly unit (410). This embodiment is advantageous in some situations in that it permits a more speedily assembly of the pallet shelf system (400) and increases the structural stability of the assembly unit (410), however, the versatility of the pallet shelf system (200) illustrated in the previous embodiment is reduced. However, also in this embodiment will the assembly unit (410) be equipped with mounting holes (420) for receiving further upright posts (220).

Figure 5:
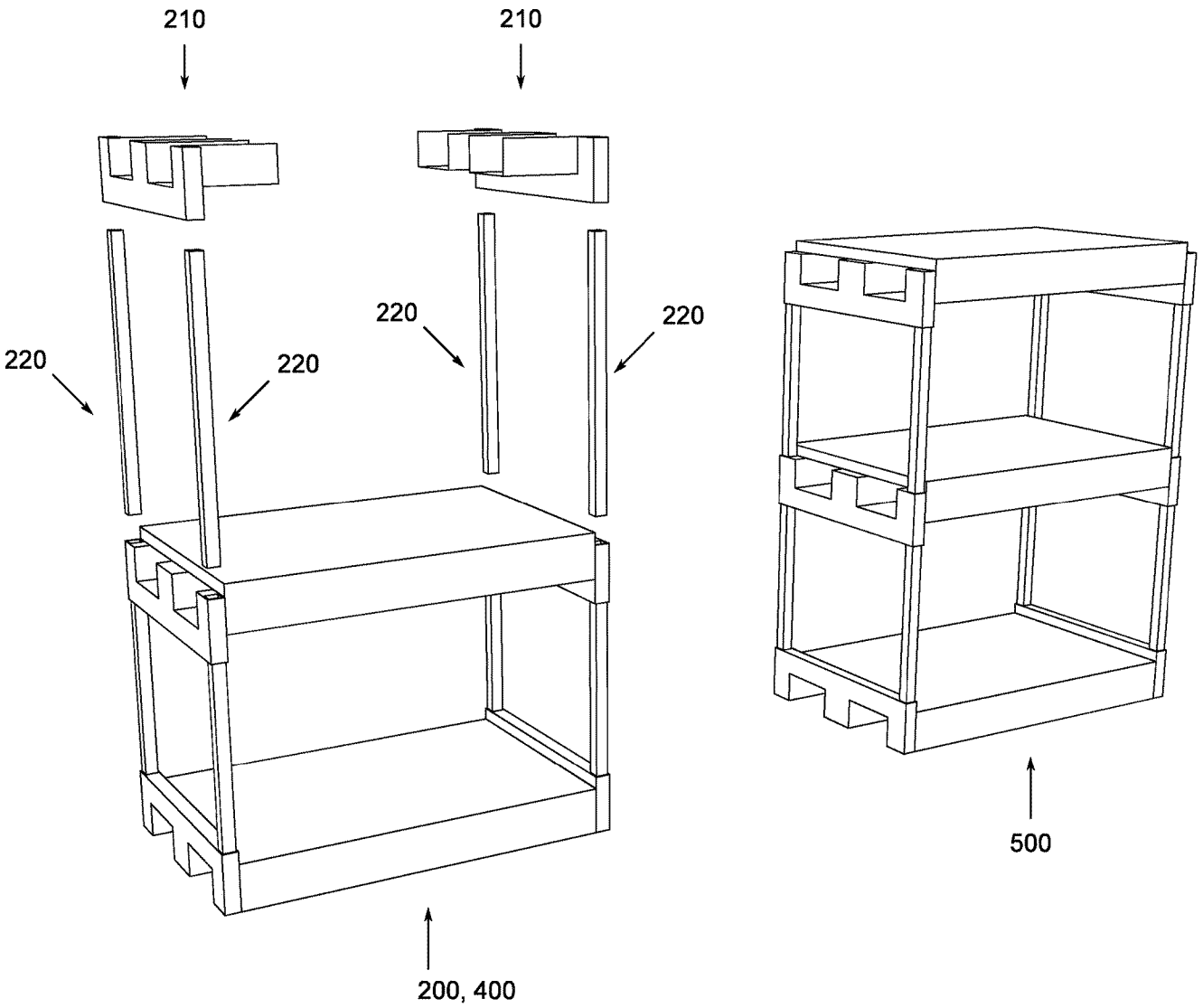
FIG. 5 shows how the pallet shelf system can be expanded to add more shelving levels.
Figure 6:
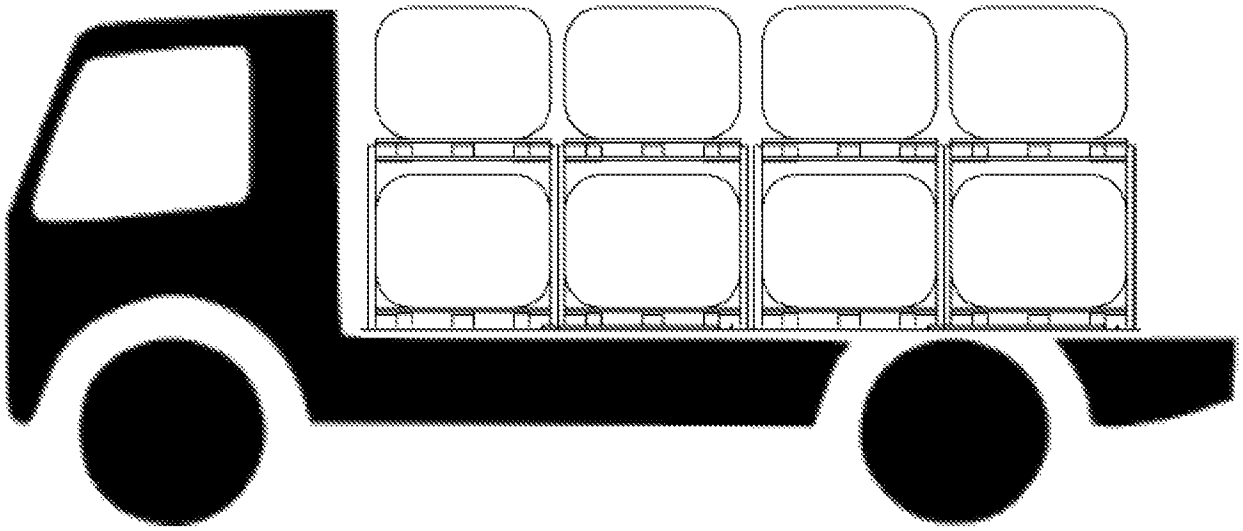
FIG. 6 illustrates an exemplary truck or lorry for use with a pallet shelf system of the disclosed embodiments.

FIG. 5 illustrates how the pallet shelf system (200, 400) can be expanded upwards by mounting further upright posts (220) into the mounting holes (213, 214, 420) of an already assembled pallet shelf system (200, 400) and adding further base units (210) and pallets (100) to serve as additional shelves in order to form an expanded pallet shelf system (500). Thereby additional shelves can be added to the pallet shelf system (200, 400, 500) in an easy manner.

In a further but not illustrated embodiment, the base unit (210) comprises two sets of protrusions, each set of protrusions located at opposite sides of said base plate (211). This enables the pallet shelf system to be expanded with further pallet shelves sideways rather than just upwards as illustrated above.

The upright posts (220) can further be supplied with longitudinal and traverse girders for further stability for additional stability. Such measures are routine for the skilled person working within the field of structural stability. Such girders may be permanently attached to the aforesaid upright posts (220) or temporarily attached to said upright posts (220) e.g. by hooking a girder element into a matching opening in the aforementioned upright post (220).

Accordingly, in one embodiment of the present invention a pallet shelf system (200, 400, 500) with at least two shelves is disclosed. The system comprises at least two standard size pallets (100), each standard size pallet (100) dimensioned according to an internationally recognized industry standard for pallets for the transport of goods; at least four upright posts (220); and at least four pallet shelf system base units (210), each base unit (210) adapted for supporting at least part of the weight of a standard size pallet (100) including goods; characterized in that said at least four base units (210) are assembled pair wise to form at least two base unit assemblies (230, 410) by joining two base units (210) using at least two of said at least four upright posts (220), thereby forming at least two of said base unit assemblies (230, 410); whereupon each base unit assembly (230, 410) is stabilized with at least two standard size pallets (100), said pallets (100) serving as shelves, thereby forming said pallet shelf system (200, 400, 500) with at least two shelves.

In a further embodiment a pallet shelf system (200, 400, 500) with at least two shelves according to the preceding paragraph is disclosed wherein said base unit assembly (410) is permanently assembled, e.g. by welding said upright posts (220) permanently onto said pallet shelf system base units (210).

In another embodiment a pallet shelf system (200, 400, 500) with at least two shelves according to the above is disclosed wherein said pallet shelf system base unit (210) comprises a base plate (211), said base plate (211) comprising at least two mounting holes (213, 214, 420), arranged on a same side of said base plate (211), said mounting holes adapted to releasable receive a said upright post (220). Further is disclosed a pallet shelf system (200, 400, 500) with at least two shelves according to the above wherein said pallet shelf system base unit (210) comprises at least two set of mounting holes (213, 214) each set of mounting holes (213, 214) arranged on an opposing side of said base plate (211).

Also disclosed is a truck or a lorry, or a trailer for a truck or a lorry, comprising a pallet shelf system (200, 400, 500) with at least two shelves according to any of embodiments above.

Finally there is disclosed, a method of creating a pallet shelf system (200, 400, 500) with at least two shelves comprising at least two standard size pallets (100), each standard size pallet (100) dimensioned according to an internationally recognized industry standard for pallets for the transport of goods; at least four upright posts (220); and at least four pallet shelf system base units (210), each base unit (210) adapted for supporting at least part of the weight of a standard size pallet (100) including goods; characterized in that said at least four base units (210) are assembled pair wise to form at least two base unit assemblies (230, 410) by joining two base units (210) using at least two of said at least four upright posts (220), thereby forming at least two of said base unit assemblies (230, 410); whereupon each base unit assembly (230, 410) is stabilized with at least two standard size pallets (100), said pallets (100) serving as shelves, thereby forming said pallet shelf system (200, 400, 500) with at least two shelves.

In a further embodiment of said method there is disclosed a method of storing goods on a pallet shelf system (200, 400, 500) with at least two shelves according to any of the above embodiments by assembling the pallet shelf system (200, 400, 500) according to the above method while the standard size pallets (100) contain goods for transportation.

In any of the above embodiments, the preferred standard size pallet (100) is a euro pallet, i.e. a standard size pallet (100) conferring to any one of the pallet size classes recognized by the European Pallet Association under their standardization program for pallets for goods transport.

The term "comprising" as used in the claims does not exclude other elements or steps. The term "a" or "an" as used in the claims does not exclude a plurality. The reference signs used in the claims shall not be construed as limiting the scope.

Although the present invention has been described in detail for purpose of illustration, it is understood that such detail is solely for that purpose, and variations can be made therein by those skilled in the art without departing from the scope of the invention.

The invention claimed is:

1. A pallet shelf system (200, 400, 500) with at least two shelves comprising:

at least two standard size pallets (100), each of the at least two standard size pallets (100) including two openings that are configured to be accessed by a fork lifter;

at least four upright posts (220); and at least four pallet shelf system base units (210), each base unit (210) configured to support at least part of the weight of a standard size pallet (100) including goods, wherein each base unit comprises at least two protrusions, the at least two protrusions configured to be disposed within the two opening of respective ones of the at least two standard size pallets;

wherein said at least four base units (210) are assembled pair wise to form at least two base unit assemblies (230, 410) by joining two base units (210) using at least two of said at least four upright posts (220), thereby forming at least two of said base unit assemblies (230, 410);

whereupon each base unit assembly (230, 410) is stabilized with at least two standard size pallets (100), said pallets (100) serving as shelves, thereby forming said pallet shelf system (200, 400, 500) with at least two shelves.

2. A pallet shelf system (200, 400, 500) with at least two shelves according to claim 1 wherein said base unit assembly (410) is permanently assembled, by welding said upright posts (220) permanently onto said pallet shelf system base units (210).

3. A pallet shelf system (200, 400, 500) with at least two shelves according to claim 1 wherein said pallet shelf system base unit (210) comprises a base plate (211), said base plate (211) comprising at least two mounting holes (213, 214, 420), arranged on a same side of said base plate (211), said mounting holes configured to releasable receive said upright post (220).

4. A pallet shelf system (200, 400, 500) with at least two shelves according to claim 3 wherein said pallet shelf system base unit (210) comprises at least two set of mounting holes (213, 214) each set of mounting holes (213, 214) arranged on an opposing side of said base plate (211).

5. A truck or a lorry, or a trailer for a truck or a lorry, comprising a pallet shelf system (200, 400, 500) with at least two shelves according to claim 1.

6. The pallet shelf system according to claim 1, wherein each pallet rests on top of the at least two protrusions.

7. A method of creating a pallet shelf system (200, 400, 500) with at least two shelves comprising:

at least two standard size pallets (100), each of the at least two standard size pallets (100) including openings that are configured to be accessed by a fork lifter;

at least four upright posts (220); and at least four pallet shelf system base units (210), each base unit (210) configured to support at least part of the weight of a standard size pallet (100) including goods, wherein each base unit comprises at least two protrusions, the at least two protrusions configured to be disposed within the two opening of respective ones of the at least two standard size pallets;

wherein said at least four base units (210) are assembled pair wise to form at least two base unit assemblies (230, 410) by joining two base units (210) using at least two of said at least four upright posts (220), thereby forming at least two of said base unit assemblies (230, 410);

whereupon each base unit assembly (230, 410) is stabilized with at least two standard size pallets (100), said pallets (100) serving as shelves, thereby forming said pallet shelf system (200, 400, 500) with at least two shelves.

8. A method of stacking goods on a pallet shelf system (200, 400, 500) with at least two shelves according to claim 7 by assembling the pallet shelf system (200, 400, 500) while the standard size pallets (100) contain goods for transportation.

* * * * *